US005910123A

United States Patent [19]

Wang

[11] Patent Number: 5,910,123

[45] Date of Patent: Jun. 8, 1999

[54] FOOT SOLE MASSAGING DEVICE

[76] Inventor: Yuh-Yun Wang, No. 6, Tung-Shi Lane, Jong-Shan Village, Waipu Shiang, Taichung, Taiwan

[21] Appl. No.: 08/863,302

[22] Filed: May 27, 1997

[51] Int. Cl.[6] ..... A61H 1/00

[52] U.S. Cl. ..... 601/50; 601/28; 601/86; 601/87

[58] Field of Search ..... 601/22, 27–32, 601/46, 50, 53, 54, 85–87, 95, 103, 104, 112, 136

[56] References Cited

U.S. PATENT DOCUMENTS

| | | | |
|---|---|---|---|
| 1,970,233 | 8/1934 | Hertzberg | 128/33 |
| 2,128,555 | 8/1938 | Benway | 128/49 |
| 3,322,117 | 5/1967 | McCaw | 128/33 |
| 5,716,331 | 2/1998 | Chang | 601/50 |
| 5,785,668 | 7/1998 | Shimizu | 601/50 |

FOREIGN PATENT DOCUMENTS

| | | | |
|---|---|---|---|
| 1513564 | 2/1968 | France | 601/27 |
| 549667 | 3/1993 | Japan . | |
| 405285190 | 11/1993 | Japan . | |
| WO9517872 | 6/1994 | Japan . | |

*Primary Examiner*—Danton D. DeMille
*Attorney, Agent, or Firm*—Browdy and Neimark

[57] ABSTRACT

A massaging device consists of a housing, a driving device, a bottom plate, a plurality of rod members and elastic elements, a vibration device, and an operation control unit. As the motor of the driving device is started, the knobbed solerests of the vibration plate of the vibration device are actuated to vibrate horizontally to stimulate the blood circulation of foot soles resting on the knobbed solerests.

8 Claims, 3 Drawing Sheets

FOOT SOLE MASSAGING DEVICE

FIELD OF THE INVENTION

The present invention relates generally to a massaging device, and more particularly to a foot sole massaging device.

BACKGROUND OF THE INVENTION

There are a variety of massaging devices intended for use in stimulating the blood circulation in a foot sole. However, these conventional foot sole massaging devices are not equipped to generate the vibration of the most suitable frequency for stimulating the foot sole effectively and comfortably.

SUMMARY OF THE INVENTION

The primary objective of the present invention is to provide an improved device for massaging a foot sole such that the blood circulation of the foot sole is effectively stimulated.

In keeping with the principle of the present invention, the foregoing objective of the present invention is attained by a foot sole massaging device, which consists of a housing, a driving device, a bottom plate, a plurality of rod members and elastic elements, a vibration device, and an operation control unit. As the motor of the driving device is started, the vibration plate of the vibration device is actuated to vibrate horizontally such that the blood circulation of the footsoles is stimulated by the knobbed solerest of the vibration plate The foregoing objective, features and functions of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
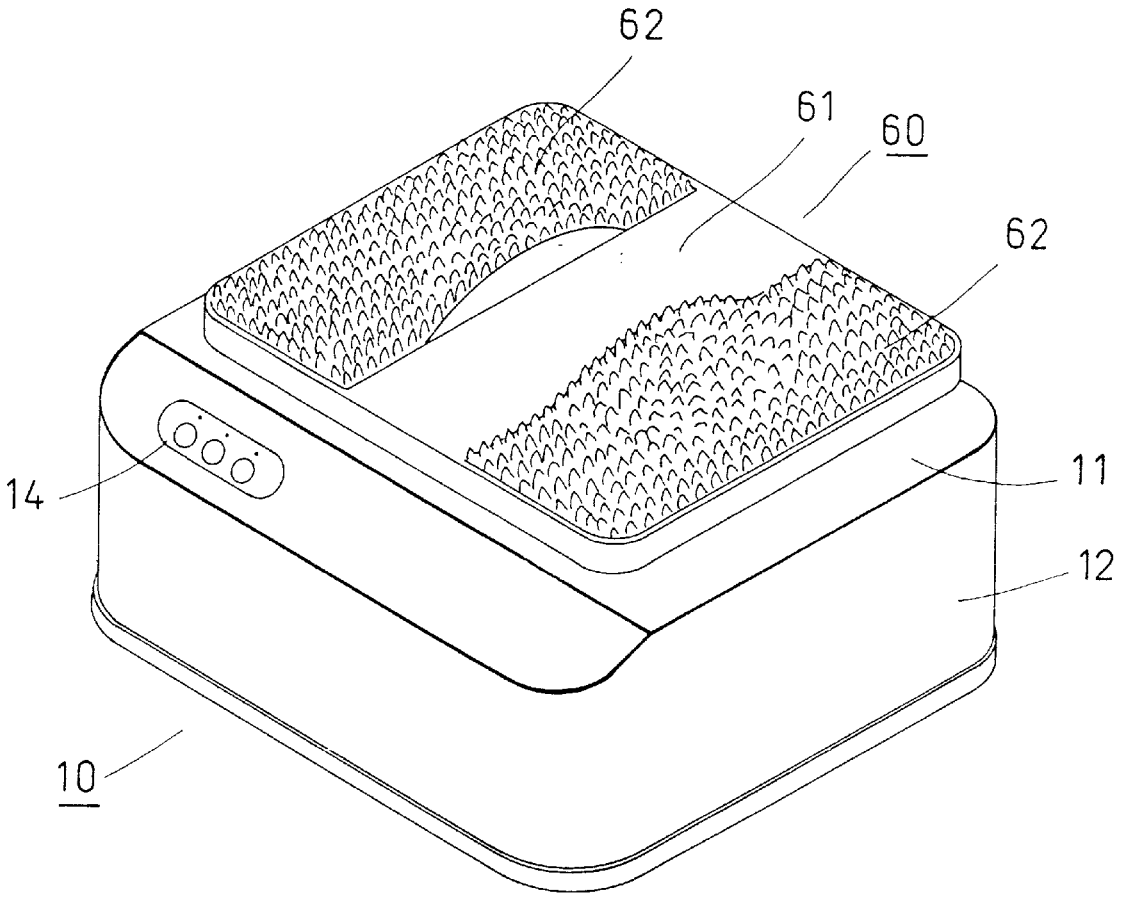
FIG. 1 is a perspective view of the preferred embodiment of the present invention.
Figure 2:
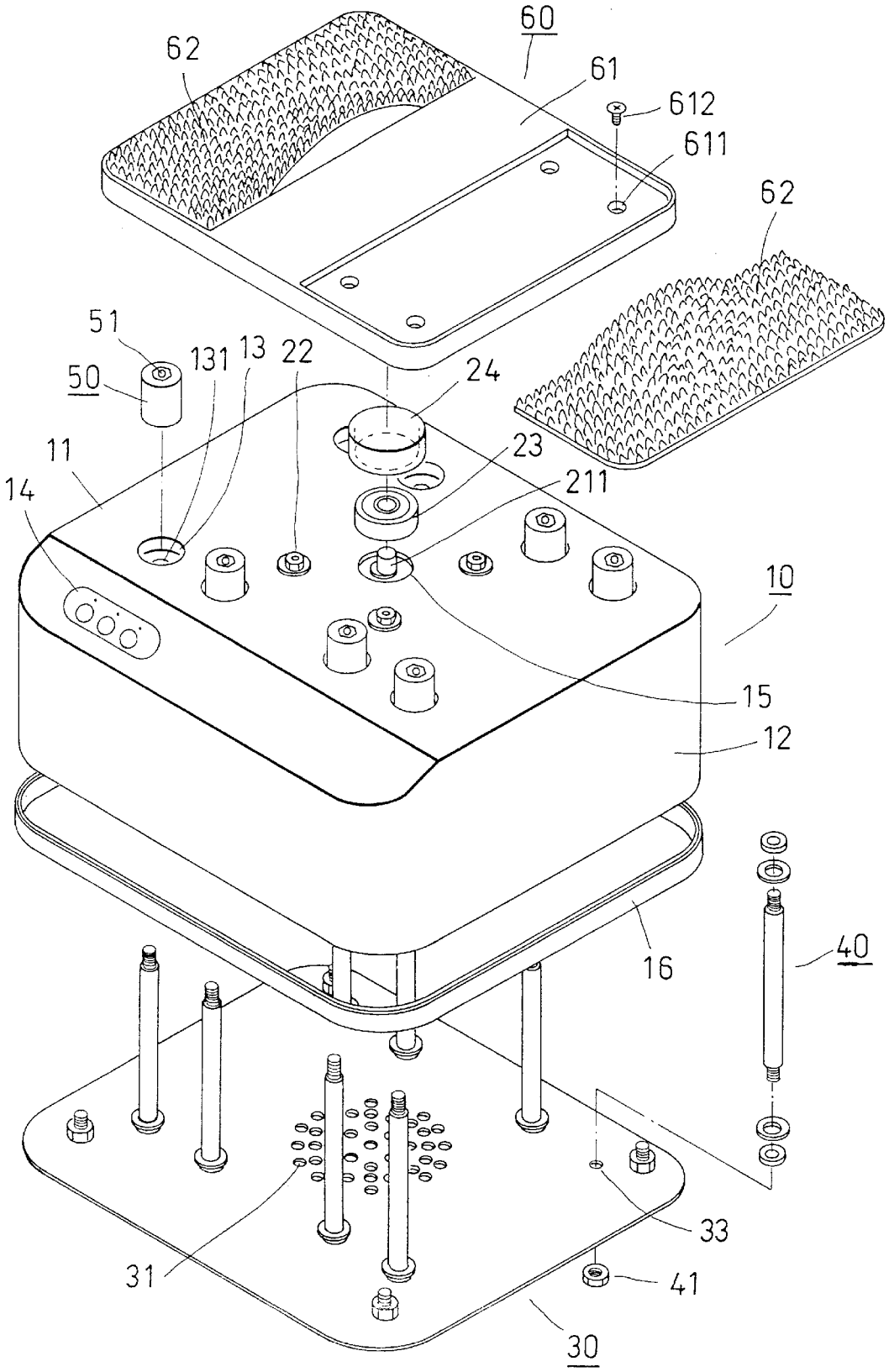
FIG. 2 is an exploded view of the preferred embodiment of the present invention.
Figure 3:
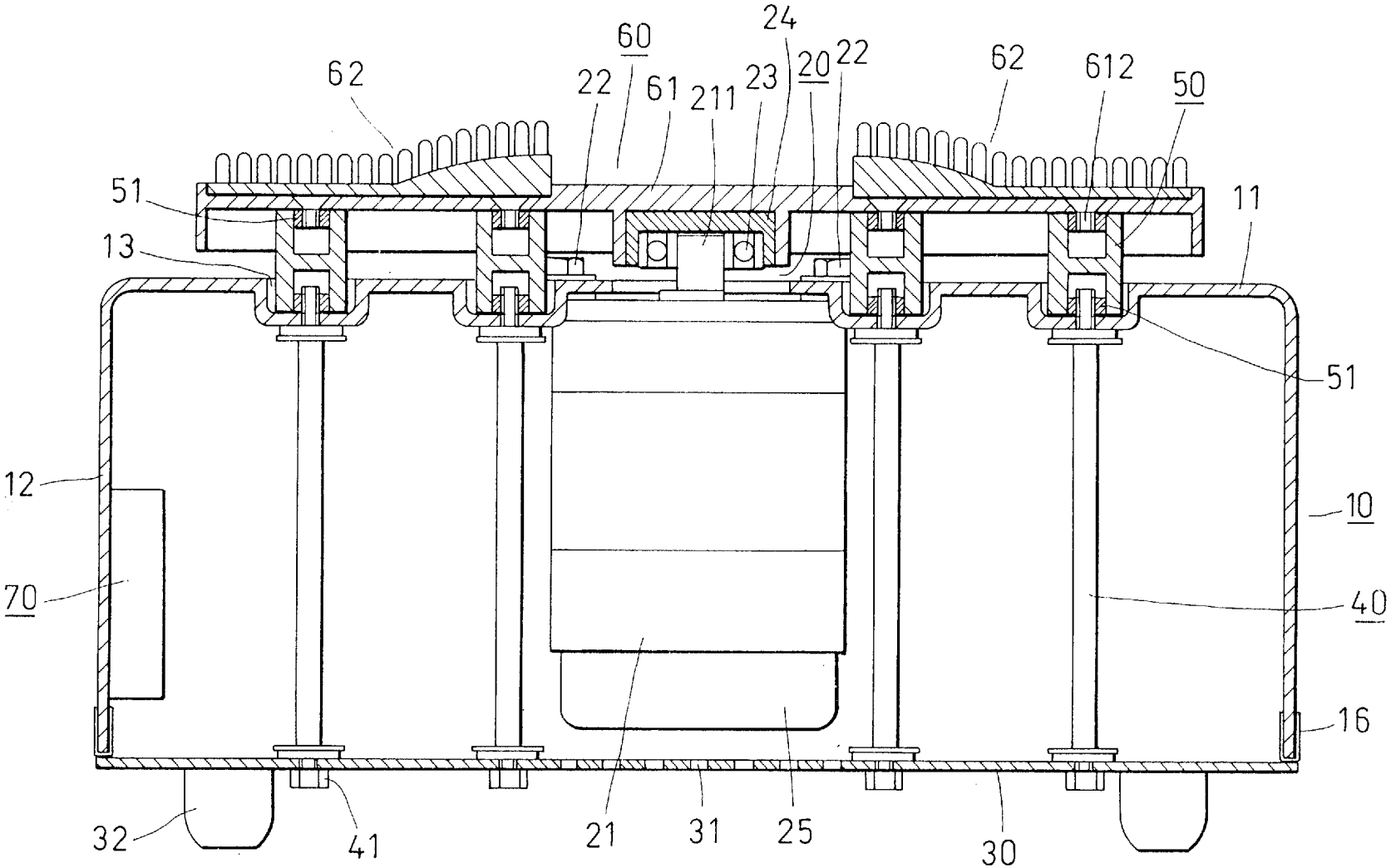
FIG. 3 is a sectional schematic view of the present invention in combination.

As shown in FIGS. 1–3, a foot sole massaging device embodied in the present invention is composed of the component parts, which are described explicitly hereinafter.

A housing 10 comprises a top plate 11 and a side frame 12 extending downwards from the edges of the top plate 11 such that a receiving space is formed and defined by the top plate 11 and the side frame 12. The top plate 11 is provided in the upper surface thereof with eight recesses 13 of a predetermined dimension. Each of the eight recesses 13 is provided at the center of the bottom wall thereof with a vent hole 131. The top plate 11 has an inclined portion which is provided with a control switch 14. Located at the center of the upper surface of the top plate 11 is a center hole 15. The housing 10 is provided at the open bottom thereof with a U-shaped rubber strip 16, which is fastened with the bottom edge of the side frame 12.

A driving device 20 comprises a motor 21 fastened to the underside of the top plate 11 of the housing 10 by means of a plurality of fastening screws 22 such that an eccentric shaft

211 of the motor axle is extended through the top plate 11 from the center hole 15. The eccentric shaft 211 is provided with a bearing 23 fastened therewith such that the bearing 23 is fitted into a rubber jacket 24. Fastened with the bottom end of the motor 21 is a heat dispersing blade 25.

A bottom plate 30 is provided with a plurality of heat dispersing holes 31 and is further provided respectively at four corners thereof with a foot 32 for locating the massaging device of the present invention on the floor. In addition, the bottom plate 30 is provided with a plurality of through holes 33 corresponding in location and number to the vent holes 131 of the recesses 13 of the top plate 11.

Eight rod members 40 are fastened between the top plate 11 and the bottom plate 30 such that the top end of each of the rod members 40 is exposed through the vent hole 131 of the recess 13, and that the bottom end of each of the rod members 40 is engaged with a nut 41 via the through hole 33 of the bottom plate 30.

Eight elastic elements 50 of a cylindrical construction are provided respectively in the hollow interior thereof with a threaded member 51 having an inner threaded hole which is engaged with the threaded top end of the rod member 40.

A vibration device 60 comprises a vibration plate 61, which is provided with a plurality of fastening holes 611 corresponding in location to the vent holes 131. The vibration plate 61 is mounted on the elastic elements 50 such that the vibration plate 61 is fastened securely with the elastic elements by means of a plurality of fastening screws 612 which are engaged with the inner threaded holes of the threaded member 51 of the elastic elements 50 via the fastening holes 611. The vibration plate 61 is provided on the upper surface thereof with two knobbed solerests 62 opposite in location to each other for kneading the soles.

An electric control unit 70 is located in the interior of the housing 10 such that the electric control unit 70 is connected with the motor 21 and the control switch 14.

As the motor 21 is started, the vibration plate 61 is actuated by the eccentric shaft 211 of the motor 21 to vibrate horizontally. Accordingly, the solerests 62 of the vibration plate 61 are caused to vibrate horizontally to knead the foot soles resting on the knobbed solerests 62. The blood circulation of the foot soles is therefore stimulated to relieve tension.

The electric control unit 70 may comprise a remote control transmitter and a signal receiver located in the interior of the housing 10 such that the signal receiver is connected with the motor 21. The revolving speed of the motor 21 can be therefore controlled by the remote control transmitter in place of the control switch 14. The vibration frequency of the vibration plate 61 can be easily regulated by the remote control transmitter at such time when the user of the device of the present invention is standing on the knobbed solerests 62 of the vibration plate 61.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. A foot sole massaging device comprising:

a housing having a top plate and a side frame extending from edges of said top plate such that a receiving space is formed and defined by said top plate and said side frame;

a driving device located in said receiving space of said housing and composed of a motor having an axle, said axle having an eccentric portion;

a bottom plate fastened to an open bottom of said housing;

a vibration device fastened pivotally with said driving device and composed of a vibration plate provided thereon with two knobbed solerests spaced from each other on opposite sides of the vibration plate; and at least four elastic elements fastened respectively at a top end thereof to four corners of said vibration plate;

wherein said top plate of said housing is provided with a plurality of recesses corresponding in location and number to said elastic elements, said recesses provided respectively at the center of a bottom wall thereof with a vent hole;

wherein said motor is fastened to the underside of said top plate of said housing such that said eccentric portion of said axle of said motor is extended through said top plate via a center hole of said top plate;

wherein said bottom plate is provided with a plurality of through holes corresponding in location to said vent holes of said recesses;

wherein said top plate and said bottom plate are provided therebetween with at least four rod members which are fastened respectively at a top end thereof with one of said elastic elements via one of said vent holes of said recesses such that a bottom end of each of said rod members is engaged with a nut via one of said through holes of said bottom plate.

2. A foot sole massaging device according to claim 1, wherein said two knobbed solerests of said vibration device are fastened with an upper surface of said vibration plate such that said two knobbed solerests are separated from each other by a predetermined distance.

3. A foot sole massaging device according to claim 2, wherein said housing is provided with a U-shaped rubber strip fastened to said open bottom of said side frame of said housing.

4. A foot sole massaging device according to claim 3, wherein said housing is further provided therein with a remote control signal receiver capable of receiving a remote control signal transmitted from a remote control transmitted for regulating the revolving speed of said motor.

5. A foot sole massaging device according to claim 2, wherein said housing is further provided therein with a remote control signal receiver capable of receiving a remote control signal transmitted from a remote control transmitted for regulating the revolving speed of said motor.

6. A foot sole massaging device according to claim 1, wherein said housing is provided with a U-shaped rubber strip fastened to said open bottom of said side frame of said housing.

7. A foot sole massaging device according to claim 6, wherein said housing is further provided therein with a remote control signal receiver capable of receiving a remote control signal transmitted from a remote control transmitted for regulating the revolving speed of said motor.

8. A foot sole massaging device according to claim 1, wherein said housing is further provided therein with a remote control signal receiver capable of receiving a remote control signal transmitted from a remote control transmitted for regulating the revolving speed of said motor.

* * * * *